US006250350B1

(12) United States Patent
Muraki et al.

(10) Patent No.: US 6,250,350 B1
(45) Date of Patent: Jun. 26, 2001

(54) METHOD OF IMPREGNATING WOOD WITH LIQUID

(75) Inventors: Toshio Muraki; Masahiro Funato; Akiko Hoshino; Tamio Arakawa, all of Iwakura (JP)

(73) Assignee: Mywood Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 08/937,472

(22) Filed: Sep. 25, 1997

(30) Foreign Application Priority Data

Oct. 22, 1996 (JP) ..... 8-299472

(51) Int. Cl.[7] ..... B27M 1/00

(52) U.S. Cl. ..... 144/380; 144/271; 144/361; 427/397; 427/440; 428/292.4; 428/359

(58) Field of Search ..... 144/329, 361, 144/380, 2.1, 271; 427/345, 377, 397, 440; 428/292.4, 357, 359, 409, 541, 921

(56) References Cited

U.S. PATENT DOCUMENTS 2,973,793 * 3/1961 Irvine ..... 144/271
5,334,445 * 8/1994 Ruyter et al. ..... 144/361
5,343,913 * 9/1994 Tanahashi et al. ..... 144/271

* cited by examiner

*Primary Examiner*—W Donald Bray
(74) *Attorney, Agent, or Firm*—Arent Fox Kintner Plotkin Kahn

(57) ABSTRACT

A method of impregnating wood with liquid puts the wood in a pressure vessel, immerses the wood in the liquid contained in the pressure vessel, pressurizes the liquid to compress the wood while keeping the temperature of the wood at or above the softening point of the wood, and reduces pressure in the pressure vessel so that the wood may cause volume relaxation in the liquid and be impregnated with the liquid.

15 Claims, 1 Drawing Sheet

METHOD OF IMPREGNATING WOOD WITH LIQUID

BACKGROUND OF THE INVENTION

1. Field of the Invention

The present invention relates to a method of impregnating wood with liquid, and particularly, to a method of efficiently impregnating conifers such as sugi (Japanese cedars) and karamatu (Japanese larches) with liquid containing preservatives, fire retardants, resin, etc., to improve the physical properties such as decay resistance and fire retardancy of the wood.

2. Description of the Related Art

Techniques of infiltrating chemicals such as preservatives and insecticides into wood tissue are widely carried out to suppress the biological deterioration of the wood and improve the durability thereof. Infiltration of fire retardants and resin into wood tissue is also achieved to improve the fire retardancy and water resistance of the wood. These chemicals and resin are dissolved or dispersed in water or organic solvents and are used in a liquid state.

A known method that is practical to efficiently infiltrate liquid into wood tissue is a vacuum-pressure treatment. This method dries wood to be treated up to a proper moisture content, puts the wood in an airtight vessel, reduces pressure in the vessel to remove air from the cells and conducting vessels of the wood, introduces liquid into the pressure-reduced vessel, and pressurizes the liquid so that the wood is impregnated with the liquid.

Since the vacuum-pressure treatment infiltrates pressurized liquid into wood through the fine cells and conducting vessels of the wood from which air has been removed, the liquid receives large resistance from the cells and conducting vessels when it passes therethrough. If the wood is axially large, the liquid takes a long time to penetrate the wood and sometimes hardly reaches the heartwood.

Accordingly, methods are studied to pretreat wood, to change the fine structure thereof so that the wood may easily be impregnated with liquid. One of the methods is a compression-recovery method. This method employs metal molds to compress wood orthogonally to the fiber axis of the wood, thereby promoting the separation of pit covers tori from pits or breaking of closed pits in the conducting vessels of the wood. This may form and expand effective paths for passing liquid in the wood. The compressed wood is transferred from the metal molds into liquid so that the wood may undergo volume relaxation and recover the shape thereof in the liquid. This produces suction force to promote penetration of the liquid into the wood. For example, Mokuzai Gakkaishi (a journal issued by the Japan Wood Research Society) reports in Vol. 41, No. 9, 1995, pp. 811 to 819 that the compression-recovery method expedited liquid penetration on seven kinds of conifers and broadleaf trees.

The compression-recovery method compresses wood in metal molds, cools the wood so that the wood temporarily keeps a compressed state, transfers the wood from the metal molds into liquid, makes the wood recover the shape thereof in the liquid, and employs the recovering force of the wood to infiltrate the liquid into the wood. Consequently, this method needs at least the following six steps of:

1) placing wood to be treated into the metal molds;
2) adjusting the wood to a predetermined temperature;
3) driving the metal molds with, for example, hydraulic pressure to compress the wood;
4) cooling the compressed wood in the metal molds and taking the wood out of the metal molds;

5) immersing the wood, which temporarily keeps the compressed state, in liquid of a predetermined temperature and letting the wood relax the volume thereof and recover the shape thereof; and
6) taking out the liquid-impregnated wood.

In this way, the conventional compression-recovery method needs the step of employing metal molds to compress wood to be treated, the step of temporarily holding the compressed state of the wood, the step of transferring the wood from the metal molds into liquid, etc. Compared with the conventional vacuum-pressure treatment, the compression-recovery method involves such troublesome steps and needs expensive metal molds and an apparatus for driving the metal molds, to increase fixed and manufacturing costs. Accordingly, the compression-recovery method is impractical, and the metal molds easily damage the surface of wood to be treated.

SUMMARY OF THE INVENTION

In view of these problems, an object of the present invention is to provide a method of efficiently and economically impregnate wood with liquid based on the compression-recovery method.

In order to accomplish the object, the invention of claim 1 puts dried wood in a pressure vessel, immerses the wood in liquid contained in the pressure vessel, pressurizes the liquid to compress the wood while keeping the temperature of the wood at or above the softening point of the wood, and reduces pressure in the pressure vessel so that the wood may undergo volume relaxation in the liquid and be impregnated with the liquid.

As stipulated in claim 2, it is preferable to keep the temperature of the wood higher than the softening point thereof while the wood is being compressed in the liquid and relaxing the volume thereof in the liquid.

As stipulated in claim 3, it is preferable, after the dried wood is put in the pressure vessel or after the wood is immersed in the liquid, to reduce or remove air contained in the wood by reducing pressure in the pressure vessel, and then, pressurize the liquid to compress the wood.

As stipulated in claim 1, the present invention compresses wood with the hydrostatic pressure of liquid and lets the wood relax in volume and recover the shape thereof in the liquid so that the liquid may infiltrate into the wood. Accordingly, the present invention needs no metal molds nor troublesome steps of placing and removing the wood into and from the metal molds and transferring the wood from the metal molds into liquid. The present invention is capable of reducing the costs related to the metal molds and an apparatus for opening and closing the metal molds.

The present invention compresses wood at a temperature higher than the softening point of the wood so that the wood is sufficiently soft to be easily and surely compressed. This results in quickly and surely separating tori from pits or breaking closed pits in the conducting vessels of the wood and easily, surely, and quickly impregnating the wood with liquid during volume relaxation of the wood. In addition, as stipulated in claim 2, the volume relaxation takes place at a temperature higher than the softening point of the wood so that the wood is sufficiently soft to relax in volume and recover the shape thereof. Namely, the volume relaxation takes place smoothly, and the wood substantially recovers the original shape thereof. At this time, the wood produces large suction force to more efficiently draw the liquid even into the heartwood.

As stipulated in claim 3, the present invention puts dried wood in the pressure vessel, and before compressing the wood, reduces pressure in the pressure vessel, to reduce or remove air from the wood. This sort of air is present in the cells and conducting vessels of the dried wood and is considered to hinder the compression, volume relaxation, and liquid impregnation of the wood, if it is not removed. By removing such air, the invention of claim 3 makes the compression and volume relaxation of the wood easier and further improves liquid penetration to the wood.

A method according to the present invention includes a compression step and a volume relaxation step. These steps will be explained in sequence.

The compression step puts dried wood in a pressure vessel and immerses the wood in liquid contained in the pressure vessel. The liquid may be put in the pressure vessel before or after placing the wood in the pressure vessel. The liquid in the pressure vessel is pressurized by a unit to be explained later, to increase pressure in the pressure vessel. The pressure applied to the liquid, i.e., the hydrostatic pressure of the liquid compresses the wood. When the pressure reaches a certain level, the wood starts to shrink, and therefore, an increase in the pressure in the pressure vessel slows down. The pressure at this point is dependent on the kind, dryness, and temperature of the wood. When the wood compression substantially completes, the pressure in the pressure vessel suddenly increases. At this time, pressurizing the liquid is stopped.

The wood to be treated may be any kind of wood, e.g., a conifer or a broadleaf tree. The wood may be a log with branches and leaves being cut off, rectangular lumber, a plank, or any other. The wood may be with or without bark. It is preferable that the wood has no surface cracks.

The wood to be treated must be properly dried. Namely, the moisture content of the wood must be properly reduced. Drying the wood makes the compression and liquid impregnation of the wood easier and smoother.

Proper degree of dryness of the wood is dependent on the kind, dimensions, liquid penetration property of the wood. It is preferable to dry the wood so that the wood may have no free water and so that the moisture content of the wood may be below a fiber saturation point. If it is presumed that the wood will crack, some free water is allowed in the wood. The "free water" is present in coarse cavities in the conducting vessels of wood without combining with the components of the wood.

To dry wood, a known methods is employed. For example, a natural drying method that leaves the wood in the atmosphere until it dries, or a kiln drying method that vaporizes water in the wood under controlled temperature and moisture is employed.

The wood to be treated according to the present invention may be softened, compressed, and mechanically squeezed to remove free water therefrom. Thereafter, the wood undergoes volume relaxation. To soften wood tissue, the wood must be heated to a temperature higher than the softening points of lignin and hemicellulose.

The step of pressuring liquid to compress the wood has different aspects. One aspect pours liquid into the pressure vessel so that the liquid sufficiently covers the dried wood in the pressure vessel. Thereafter, the liquid is pressurized and additional liquid is poured into to fill the pressure vessel. Once the liquid compresses the wood to a required extent, the pressure applied to the liquid is stopped. It is possible to put a predetermined quantity of liquid in the pressure vessel in advance, place the dried wood in the pressure vessel, and pour pressurized liquid into the pressure vessel.

Another aspect introduces liquid into the pressure vessel so that the liquid sufficiently covers the dried wood in the pressure vessel. It is possible to put a predetermined quantity of liquid in the pressure vessel in advance. The quantity of the liquid must be sufficient to completely cover the wood even after the liquid infiltrates into the wood due to volume relaxation to be explained later. Thereafter, pressurized gas such as air is introduced into the pressure vessel, to increase the pressure of the liquid in the pressure vessel and compress the wood. When the wood is compressed to a required extent, the pressurized gas is stopped.

The compressing pressure of the liquid applied to the wood is dependent on the kind, moisture content, and temperature of the wood. Preferably, the pressure is about 10 to 30 $kgf/cm^2$ . The wood must be compressed at a temperature higher than the softening point of the wood. If the wood is compressed at a temperature lower than the softening point, a higher pressure is required. This is uneconomic in terms of facilities and energy, easily damages the fine structure of the wood due to high-pressure compression, and causes unwanted phenomena such as a decrease in the strength of the wood. It is preferable that the compression step achieves a compression ratio of about 50% or above on the wood.

It is, however, not always necessary to achieve desired compression ratio in a single step. Repeating the compression-volume relaxation cycles several times, with maximum liquid pressure for the cycle increasing with repetition time, is acceptable as long as the sum of individual compression ratios is reasonably high (about 50%). This repeating technique is recommendable for knotty wood which is apt to show a decrease in strength when it is compressed at a high ratio.

The softening point of wood is dependent on the kind and moisture content of the wood. Generally, it is about 80° C. to 100° C. if the moisture content of the wood is around the fiber saturation point of the wood. For example, soft conifers such as sugi (Japanese cedars) and karamatu (Japanese larches) sufficiently soften at about 80° C. to 100° C. if the moisture content thereof is around the fiber saturation point thereof. These soft conifers are easy to compress to 40% to 50% of the original volume thereof with a hydrostatic pressure of 10 to 15 $kgf/cm^2$.

The volume relaxation step that follows the compression step is carried out by partly discharging the liquid or the pressurized gas from the pressure vessel, to decrease pressure in the pressure vessel. As a result, the wood causes volume relaxation and starts to recover the original shape thereof. This produces suction force to draw the liquid into wood tissue. To smoothly cause the volume relaxation, it is preferable to carry out the volume relaxation step at a temperature higher than the softening point of the wood. If the pressure in the pressure vessel is dropped with the temperature of the wood being kept at or above the softening point, the wood substantially recovers the volume it had before the compression step, and therefore, the liquid efficiently infiltrates into the wood up to the heartwood. Generally, the softening point of wood having a moisture content of around the fiber saturation point thereof is about 80° C. to 100° C. At these temperatures, the viscosity of the liquid greatly decreases compared with that at the room temperature, and therefore, the liquid more easily penetrates the wood through capillary tubes.

Pressure in the pressure vessel during the volume relaxation step is properly determined according to the kind, moisture content, temperature, etc., of the wood. The pressure in the pressure vessel may be dropped to a predetermined value all at once. In this case, it is preferable to keep the pressure vessel at a pressurized state instead of dropping it to atmospheric pressure, to maintain the liquid penetration effect to the wood.

If the pressure in the pressure vessel is dropped all at once, the wood will not properly recover the shape thereof or, depending on the kind and nature of the wood, will suffer surface cracks. To avoid this, the pressure in the pressure vessel must be dropped step by step or continuously.

Thereafter, the remaining liquid is discharged from the pressure vessel and the wood is taken out of the pressure vessel. The wood thus obtained is properly dried into a product.

After dried wood is put in the pressure vessel and before the compression step is carried out, a pressure reduction step may be carried out to further improve liquid penetration to the wood. The pressure reduction step is effective because wood that is dried to some extent contains air in the cells and conducting vessels thereof, and it is considered that such air hinders the compression, volume relaxation, and liquid impregnation of the wood. Accordingly, the pressure reduction step places the wood in a pressure reduced atmosphere to reduce or remove such air from the wood, to make the compression, volume relaxation, and liquid impregnation of the wood easier. The pressure reduction step is carried out in the pressure vessel, and the vacuum treated wood is processed as it is in the next compression step.

It is characteristic of the present invention that liquid can be impregnated in logs and lumber rather uniformly mainly through end surfaces or cut ends of vessels or tracheids. For practical purposes, the liquid will be solutions or dispersions of wood preservatives, dyestuffs, monomers, prepolymers and other additives. Creosote, liquid monomer or prepolymer can be impregnated without solvent as long as the liquid is suitable at treatment temperature.

These additives protect wood against rot fungi and termites, give the wood colourful cut surfaces, or bring about wood compositions with improved properties.

There are, however, a definite restriction for the liquids to be used in the present invention. The liquids must be stable for long time at treatment temperature which is typically about 100 degree C. In case of wood preservatives, very popular types which contain copper or zinc compounds are not acceptable, since these compounds are apt to decompose in hot water. On the other hand, boric acid, phosphoric acid, polyphosphoric acid and their sodium or ammonium salts are very soluble in hot water giving stable solution. Thus these wood preserving chemicals can be evenly impregnated even in wood with large dimensions at a desired level by use of the present invention. Creosote is another example of wood preservative which can be impregnated in wood according to the present invention.

In case of wood preservatives like polychloro phenols, impregnation will be carried out in the form of solution in a volatile organic solvents. Volatile solvent can be easily recovered after impregnation.

It should be stressed that uniform impregnation of preservatives, dyestuffs or monomers in wood has many practical advantages. In case of the present treatment, which is most popular treatment method today, impregnation of the preservatives is limited to surface layers of 10 to 20 millimeters in depth. Most of the internal regions are free from the preservatives. Thus, once rain water, for example, reach inside the treated wood through cracks, drilled or nailed holes, deterioration stars from the inside. These unfavorable but rather common incidents are to be stopped by use of the method of the present invention which allows uniform distribution of preservatives in treated wood.

DESCRIPTION OF THE PREFERRED EMBODIMENTS

Figure 1:
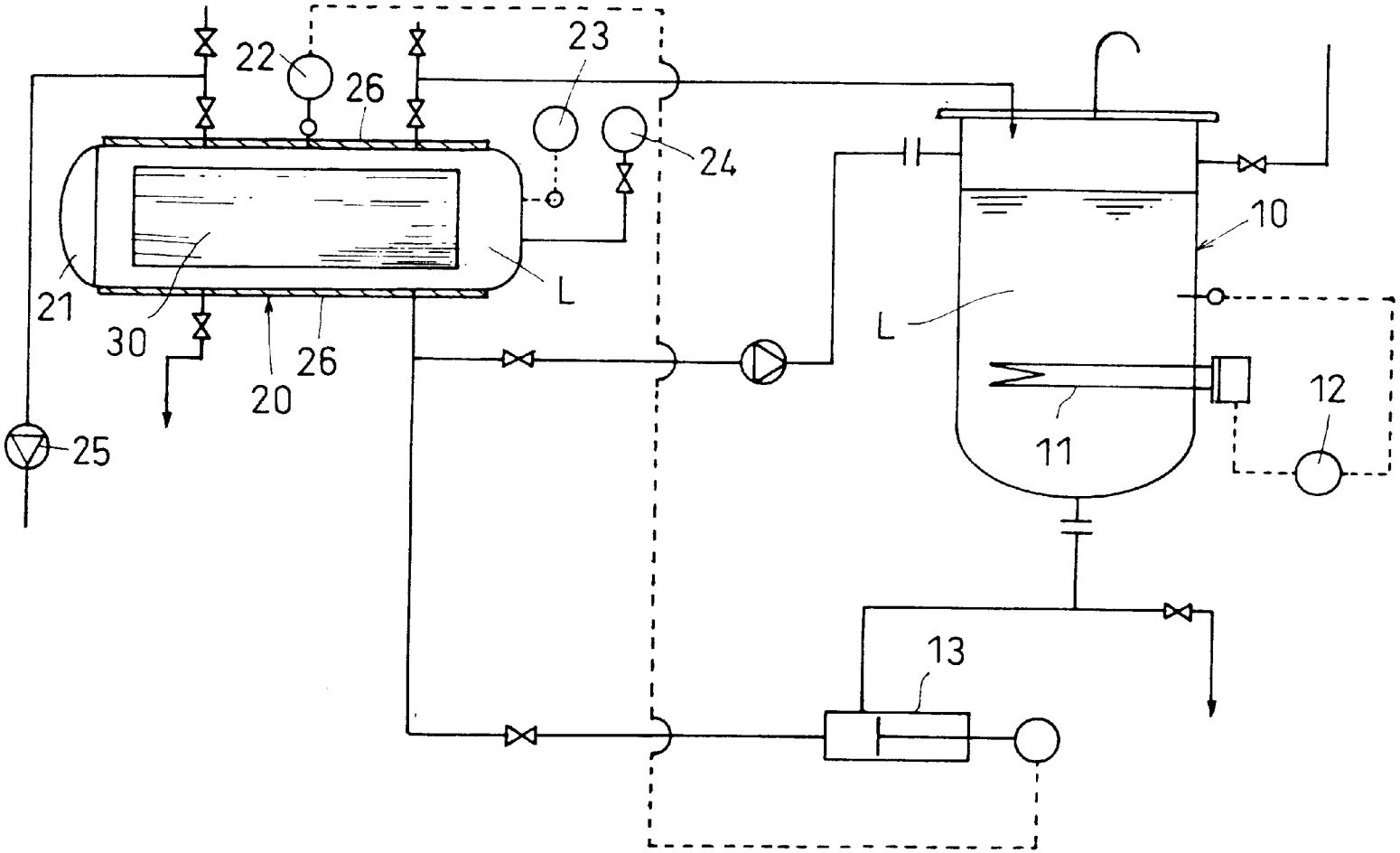
FIG. 1 is a schematic view showing a system for achieving a method of impregnating wood with liquid according to the present invention.

Embodiments of the present invention will be explained with reference to the accompanying drawing.

FIG. 1 shows a system for achieving a method of impregnating wood with liquid according to the present invention. Reference numeral 10 is a liquid tank, 20 is a pressure vessel, and 30 is wood.

The tank 10 has a heater 11 and a temperature adjuster 12 that control the temperature of liquid L contained in the tank 10 to a required level. Numeral 13 is a liquid supply pump. The pressure vessel 20 has a lid 21 for passing the wood 30, a pressure adjuster 22, a temperature adjuster 23, a pressure gauge 24, a vacuum pump 25, a heater 26 for heating liquid contained in the pressure vessel 20.

Embodiments of the present invention employing the system of FIG. 1 will be explained. To clearly show the effect of the present invention, comparisons will also be explained. Each of the comparisons carries out the compression and volume relaxation steps at a temperature below the softening point of wood.

(Embodiment 1)

A barked log of sugi naturally dried to a moisture content of 23% and having a top end diameter of 17 cm and a length of 70 cm was prepared as the wood 30. The wood 30 was put in the pressure vessel 20. The vacuum pump 25 was operated to achieve a vacuum of 25 mmHg in the pressure vessel 20, which was kept under this state for 60 minutes to carry out the pressure reduction step.

The liquid L (blue liquid: 0.5% aqueous solution of Patent Blue) heated to 90° C. was pumped up by the pump 13 from the tank 10, to fill the pressure vessel 20. The pressure vessel 20 was heated with the heater 26 arranged around the pressure vessel 20. The internal pressure of the pressure vessel 20 was kept at one atmosphere and the temperature of the liquid L at 85° C. to 95° C. higher than the softening point (80° C.) of the wood 30. These conditions were kept for 60 minutes to soften the wood 30. The liquid L at 90° C. was pressurized and pumped into the pressure vessel 20 to carry out the compression step. At this time, the internal pressure of the pressure vessel 20 started to increase, and at about 10 atmospheres, the increasing speed thereof slowed down due to the compressive deformation of the wood 30. The pressurized liquid L was continuously pumped into the pressure vessel 20 until the internal pressure of the pressure vessel 20 reached 32 atmospheres. Under this pressure, the temperature of the liquid in the pressure vessel 20 was kept at 90° C. or five minutes.

The liquid L in the pressure vessel 20 was partly discharged to drop the internal pressure of the pressure vessel 20 to eight atmospheres to carry out the volume relaxation step. This pressure was maintained for 30 minutes. Then, the heater 26 was stopped, the remaining liquid L was completely returned from the pressure vessel 20 to the tank 10, and the wood 30 was taken out of the pressure vessel 20. Although the obtained wood showed slight deformation on the circumference thereof, the diameter thereof was substantially equal to the original one, and an increase in the weight of the wood was 130% of the original one. The surface of the treated wood was entirely colored in blue, and no internal cracks were observed. The wood was cut at the longitudinal center thereof, and the cross section at the cut was observed. The sapwood and heartwood at the cut were both colored in blue. It was confirmed, therefore, that the wood was evenly impregnated with the blue liquid.

(Comparison)

A barked log of sugi naturally dried to a moisture content of 30% and having a top end diameter of 15 cm and a length of 60 cm was put in the pressure vessel 20. The liquid L (blue liquid) at the room temperature was introduced from the tank 10 into the pressure vessel 20 and was pressurized to increase the internal pressure of the pressure vessel 20 to 32 atmospheres. This state was kept for five minutes, and then, the internal pressure of the pressure vessel 20 was dropped to eight atmospheres as in the embodiment 1. This pressure was kept for 60 minutes. The remaining liquid was discharged, and the log was taken out of the pressure vessel 20. An increase in the weight of the log was 70% of the original one. The wood was cut at the longitudinal center thereof, and the cross section at the cut was observed. Most of the sapwood at the cut was colored but the heartwood was not.

(Embodiment 2)

The same wood as that of the embodiment 1 was prepared. The wood was impregnated with the liquid L similar to the embodiment 1 without carrying out the pressure reduction step. The obtained wood was slightly pale-colored at the heartwood compared with the embodiment 1. The other part of the wood was substantially evenly colored.

(Embodiment 3)

The heartwood of a sugi was cut into a flat-grain board of 50 mm in length in the radial direction, 150 mm in length in the tangential direction, and 800 mm in length in the longitudinal direction. The board was naturally dried to a moisture content of 26%. The board was put in the pressure vessel 20. The pressure vessel 20 was depressurized by the vacuum pump 25 to a vacuum of 25 mmHg. The liquid L (blue liquid: 0.5% aqueous solution of Patent Blue) heated to 95° C. was pumped up by the pump 13 from the tank 10, to fill the pressure vessel 20. The pressure vessel 20 was heated by the heater 26 arranged around the pressure vessel 20. The pressure vessel 20 was kept under a pressure of one atmosphere and a liquid temperature of 90° C. to 95° C. or 60 minutes, to soften the board. While the pressure vessel 20 was continuously being heated, the liquid L was pressurized and supplied from the tank 10 into the pressure vessel 20 again. When the internal pressure of the pressure vessel 20 reached about 18 atmospheres, the liquid L was stopped. The pressure vessel 20 was maintained under this pressure for 60 minutes.

The liquid L in the pressure vessel 20 was partly discharged to drop the internal pressure of the pressure vessel 20 to eight atmospheres. Thirty minutes later, the heater 26 was stopped, and the remaining liquid L was completely returned from the pressure vessel 20 to the tank 10. Then, the board was taken out of the pressure vessel 20. An increase in the weight of the board was 110% of the original one. The obtained board had substantially the original dimensions thereof except the length in the radial direction that was slightly shortened. The surfaces of the board were entirely colored in blue. The board was cut at the longitudinal center thereof, and the cross section at the cut was observed. The cross section at the cut was entirely colored in blue, and it was confirmed that the board was evenly impregnated with the blue liquid.

As explained above with reference to the figure, the method of the present invention impregnates wood with liquid without employing metal molds to compress the wood. Accordingly, the present invention involves no troublesome work and labor to put and take the wood in and out of the metal molds, nor an apparatus for opening and closing the metal molds. Accordingly, the present invention is capable of manufacturing liquid-impregnated wood at low cost.

The present invention compresses wood with the hydrostatic pressure of liquid in a pressure vessel and reduces pressure in the pressure vessel to cause volume relaxation of the wood, thereby quickly impregnating the wood with the liquid. When the wood is compressed in the pressure vessel, the temperature of the wood is kept at or above the softening point of the wood. Accordingly, the wood is greatly deformed through the compression and volume relaxation steps, to surely infiltrate the liquid into the heartwood. If the wood is kept above the softening point during the volume relaxation, the wood will more efficiently and surely be impregnated with the liquid. Since there are no metal molds that contact the wood, the wood never suffers from surface damage. As a result, the wood has a high commercial value.

The present invention may reduce the internal pressure of the pressure vessel before compressing the wood with liquid pressure. This reduces or removes air from the wood and efficiently infiltrates the liquid into the wood; otherwise the air remains in wood tissue to hinder the compression, volume relaxation, and liquid impregnation of the wood.

What is claimed is:

1. A method of impregnating wood with liquid, comprising the steps of:

putting the wood, which is dried, in a pressure vessel so that the wood is immersed in the liquid contained in the pressure vessel;

keeping the temperature of the wood at or above a softening point of the wood and pressurizing the liquid to compress the wood; and reducing the internal pressure of the pressure vessel, to cause volume relaxation of the wood in the liquid so that the liquid infiltrates into the wood.

2. The method of claim 1, wherein the temperature of the wood is kept at or above the softening point of the wood during the compression and volume relaxation of the wood in the liquid.

3. The method of claim 1, wherein, after the wood is put in the pressure vessel or after the wood is immersed in the liquid, the internal pressure of the pressure vessel is reduced to reduce or remove air contained in the wood, and then, the liquid is pressurized to compress the wood.

4. The method of any one of claim 1, 2 or 3, wherein the liquid to be impregnated is aqueous wood preservative solution containing at least boric acid or a borate as a vital ingredient.

5. The method of any one of claim 1, 2 or 3, wherein the liquid to be impregnated is aqueous wood preservative solution containing at least phosphoric acid or polyphosphoric acid or a water soluble salt of either of the said acids as a vital ingredient.

6. The method of any one of claim 1, 2 or 3, wherein the liquid to be impregnated is wood preservative comprising creosote as the major ingredient.

7. The method of any one of claim 1, 2 or 3, wherein the liquid to be impregnated is solution of organic wood preservative in a volatile organic solvent.

8. The method of any one of claim 1, 2 or 3, wherein the liquid to be impregnated is aqueous solution of one or more dyestuffs.

9. The method of any one of claim 1, 2 or 3, wherein the liquid to be impregnated is monomer and/or prepolymer or solution of monomer and/or prepolymer in water or volatile organic solvent.

10. A ligneous material obtained by the method according to claim 4, 5, 6 or 7, wherein wood preservatives are rather uniformly dispersed in the wood matrix.

11. A ligneous material obtained by the method according to claim 8, wherein one or more dyestuffs are rather uniformly dispersed in the wood matrix.

12. A ligneous composite material obtained by polymerzing monomer and/or prepolymer which has been impregnated in the wood matrix by the method according to claim 9.

13. A ligneous material obtained by the method according to claim 5, wherein wood preservatives are rather uniformly dispersed in the wood matrix.

14. A ligneous material obtained by the method according to claim 6, wherein wood preservatives are rather uniformly dispersed in the wood matrix.

15. A ligneous material obtained by the method according to claim 7, wherein wood preservatives are rather uniformly dispersed in the wood matrix.

* * * * *